United States Patent [19]

Hamilton

[11] 4,318,499

[45] Mar. 9, 1982

[54] RETAINER AND PROPULSION APPARATUS CARRIED IN A SELF-CONTAINED HANDLE FOR USE WITH A REMOVABLE CARTRIDGE

[76] Inventor: Joel A. Hamilton, 101 Hardenburgh Ave., Demarest, N.J. 07627

[21] Appl. No.: 179,257

[22] Filed: Aug. 18, 1980

[51] Int. Cl.[3] ..... B67D 5/42

[52] U.S. Cl. ..... 222/327; 74/141.5; 74/501 R; 222/391

[58] Field of Search ..... 74/141.5, 160, 501 R; 222/391, 327

[56] References Cited

U.S. PATENT DOCUMENTS

| | | | |
|---|---|---|---|
| 2,240,046 | 4/1941 | Marra | 222/391 |
| 2,587,454 | 2/1952 | Fletcher et al. | 74/501 R X |
| 2,617,560 | 11/1952 | Pietrzak | 222/391 X |
| 2,732,102 | 1/1956 | Ekins | 222/391 X |
| 3,161,325 | 12/1964 | Hinkel et al. | 222/391 X |
| 3,221,409 | 12/1965 | Thiel et al. | 222/391 X |
| 3,229,865 | 1/1966 | Heisler et al. | 222/391 |
| 3,771,384 | 11/1973 | Hackman | 74/501 R X |

FOREIGN PATENT DOCUMENTS

| | | | |
|---|---|---|---|
| 672461 | 3/1939 | Fed. Rep. of Germany | 222/391 |

*Primary Examiner*—David A. Scherbel
*Attorney, Agent, or Firm*—Ralph R. Roberts

[57] ABSTRACT

This invention pertains to a disposable tubular cartridge and apparatus for expelling the contents from said cartridge. This novel apparatus does not employ the conventional U-shaped receiver into which the cartridge is placed but provides a self-contained handle to which the rear of the cartridge is attached. This handle is usually a pistol grip in shape. Rather than a rigid ratchet expelling shaft and an exterior twist handle the present apparatus provides a curved trackway and an expelling drive train, a portion of which is flexible in one direction. The drive train has a ratchet engaged and moved by a lever handle and a pivoted pawl leaf. A stop finger is carried by this lever handle and is disposed to prevent counterflow movement of the drive train. Several methods are shown for attaching the tubular container and the drive train is also shown employing several alternate constructions. In each embodiment the lever handle and associated members are swung to a disengaged condition whereat and whereby the piston disc carried by a rigid shank portion may be manipulated for moving the drive train to a retracted position and condition.

17 Claims, 6 Drawing Figures

RETAINER AND PROPULSION APPARATUS CARRIED IN A SELF-CONTAINED HANDLE FOR USE WITH A REMOVABLE CARTRIDGE

BACKGROUND OF THE INVENTION

1. Field of the Invention

The invention relates to self contained dispensers having removable cartridge-type containers having piston followers to expel material out the dispensing nozzle and a handle receiving the cartridge and having a propulsion apparatus to push the piston along the container to effect the dispensing of the material.

2. Description of the Prior Art

Disposable cartridges are very well known and provide nearly the entire packaging for sealants, adhesives, repairs and many other products too numerous to mention. These cartridges are used for an ever expanding field of use but so far as is known these devices usually employ a carrier which has a U-shaped frame and has a ratchet rod. This rod is turned to place the teeth in a ratchet condition for forward movement and a quarter turn to disengage the ratchet for withdrawal of the rod. This U-shaped carrier is usually made of sheet metal with the ratchet rod of steel and not only rectangular but of full rigid length.

There are many patents showing a U-shaped cartridge holder commonly used. Few holders are shown that grip only the rear portion of the casing and in these the conventional rigid ratchet apparatus and quarter turn handle is employed for the expelling action. Retraction requires turning the ratchet rod for withdrawal. The flexible expelling apparatus of this invention is not shown.

In the present invention the propelling apparatus and cartridge retention are provided by a pistol-type grip handle. The propelling device, more-or-less, is arranged in a fold-back or close return. The attachment of the cartridge is by a simple formed end.

SUMMARY OF THE INVENTION

This invention may be summarized, at least in part, with reference to its objects. It is an object of this invention to provide, and it does provide, a disposable cartridge retainer in which the propulsion apparatus and attachment of the disposable container is provided in the same handle.

It is a further object of this invention to provide, and it does provide, a self-contained retainer having a propulsive apparatus for expelling the contents of the cartridge. This propulsive apparatus including a flexible, pawl advanced expulsion piston with the flexible drive means retained and movable in a curved track. The attachment of the cartridge is by a simple mounting at the forward end of the handle and does not require the conventional U-frame.

In brief, this invention contemplates the propulsive and attachment means as carried by and enclosed by a pistol grip handle. The expulsion apparatus of the disposable cartridge includes a drive member that is bendable or flexible in one direction. This flexibility allows the propulsive mechanism to be carried in a U-shaped track or retainer. This mechanism is moved forwardly by a pawl and retraction is by a pin or similar means. Attachment of the cartridge is by screw thread, bayonet lock, a detent or clamp so that the cartridge is not and need not be carried by a U-shaped support that engages and retains the front end of the cartridge.

In addition to the above summary the following disclosure is detailed to insure adequacy and aid in understanding of the invention. This disclosure, however, is not intended to cover each new inventive concept no matter how it may later be disguised by variations in form or additions of further improvements. For this reason there has been chosen specific embodiments of retainer and propulsion apparatus as adopted for use with a disposable cartridge and showing a preferred means for retaining said cartridge and constructing a flexible propulsion apparatus. These specific embodiments have been chosen for the purposes of illustration and description as shown in the accompanying drawing wherein:

BRIEF DESCRIPTION OF THE DRAWING

In the following description and in the claims various details are identified by specific names for convenience. These names are intended to be generic in their application. Corresponding reference characters refer to members throughout the six figures of the drawing.

EMBODIMENT OF FIG. 1

Figure 1:
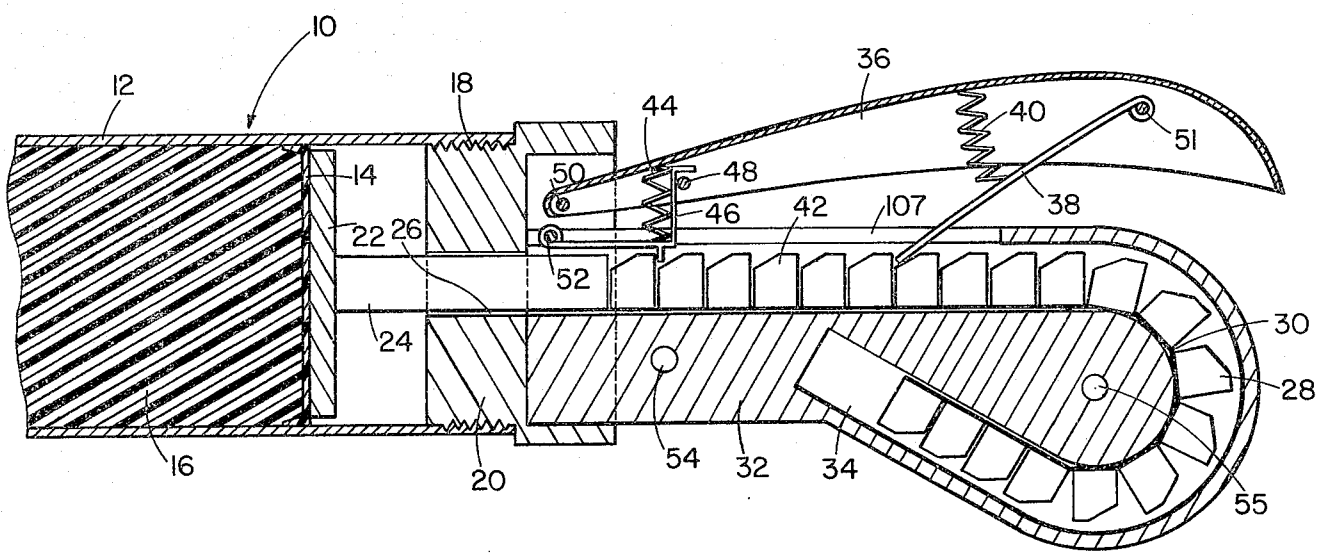
FIG. 1 represents a side view, partly diagrammatic, and in substantially a full scale, of the drive to expell the contents of the disposable cartridge, this view showing the cartridge attached by thread form.

Referring to the drawings and in particular to FIG. 1, there is shown a side view, partly in section and partly diagrammatic, of a pistol grip expulsion apparatus for use with a throw-away cartridge. A cartridge container 10 has the usual tubular body 12 of plastic, impregnated paper, tightly wound paper and/or cardboard. This cartridge is filled with the usual fluent material such as caulk, adhesive and the like 16. The discharge tip, which is to the left of this view, is conventional and is usually tapered. This tip is usually of molded plastic and has a closed end providing a hermetic seal. A knife or the like is used to remove the extreme end of the tip for discharge of the contents of the container. A cup-shaped end closure 14 is moved leftwardly. A rear seal, which is removable, may be provided for hermetic reasons but is not shown.

An internal thread 18 is depicted on the right end of the tubular body 12 and a compatible thread is formed on end member 20. This thread enables the tubular body 12 to be securely mounted to end member 20. A piston disc 22 is secured to a shank portion 24 which is freely movable in and through an aperture 26 in end member 20. To the shank portion 24 is sequentially provided block members 28 which are of like size and configuration. These sequentially arrayed block members 28 are secured to a flexible strip 30. This strip may be plastic or cloth and is contemplated to have a slide surface on the side opposite the secured block members.

This strip 30 is carried in a housing 32 which may be of two equal halves that are mirror images of each other or may be with unequal portions with one portion providing a track and the other portion providing a cover. Preferably provided in these portions that make up the housing is a curved track 34 providing a support and guide for the block members 28 attached to the flexible strip 30.

Pivotally attached to end member 20 is a lever handle 36 which carries a pawl leaf 38. A spring 40 urges the pawl leaf 38 toward and into a beveled notch 42 formed and provided on each block member 28. Also carried by this lever handle 36 is a second spring 44 that urges the lever handle 36 outwardly into the position shown. The lower or inner end of this second spring 44 is secured to a stop finger which is also pivotally secured to end member 20. A pin 48 secured in the lever handle 36 prevents unwanted disengagement of the lever handle 36 from the second spring 44 and the stop finger 46.

Pivot pins 50, 51 and 52 are identified to show their relationship to the dispenser. One or more screws 54 and 55 are illustrated as a means of closing the housing and securing the members of halves together. The end member 20 is adapted for securing the housing 32 to provide a handle means. As depicted, the apparatus is preferably in the form of a pistol grip arrangement.

USE AND OPERATION

The dispenser apparatus of FIG. 1 is typical of all the succeeding embodiments in its general operation. The cartridge container 10 is a disposable tubular member that is secured to the end member 20 by attaching means. In the embodiment of FIG. 1 this attachment is shown as a thread 18. Other attaching means are discussed in later FIGURES. Typical of the disposable cartridges is a slidable cup-shaped end closure 14. This cup-shaped disk is usually interior of the cartridge whose large end (right) may be hermetically sealed with and by a self-stick seal that is removed prior to attachment and use.

With the cartridge attached to the end member 20 the lever handle 36 is actuated with a pushing action to urge said lever handle 36 toward the housing 32. As handle 36 is moved the pawl leaf 38 engages a rear engaging face of a block member 28 to move the shank portion 24 and the attached piston disc 22 forwardly. The pawl leaf 38 moves backward (rightwardly) as the lever handle 36 is urged upwardly by second spring 44 which also engages and moves the stop finger 46 into a restraining position. The stop finger has a downwardly directed engaging portion 58 disposed to engage the rear vertical surface of a block member 28.

Repeated actuation of the lever handle 36 urges the piston disc 22 forwardly and the associated cup-shaped closure 14 is moved with the advancement of the disc 22. The connected block members 28 are carried in this track and with each actuation of the lever handle 36 the expulsion of the fluent material 16 is made from the cartridge 10. After expulsion is completed the disc 22 is returned to the rear position next to end member 20. The apparatus of FIG. 1 anticipates that the removal of the cartridge 10 may be achieved by a simple unscrewing action. The lever handle 36 is swung upwardly from its drive condition of FIG. 1 and with both the pawl leaf 38 and the stop finger 46 in a disengaged condition the disc 22 and the attached blocks 28 are moved to a new start condition. Pin 48 prevents spring 44 from exceeding the lift limit as well as enabling lever handle 36 to be swung to a disengaged condition. The beveled notch 42 provides the ramp surface to lift the engaging portion 58 of stop finger 46 as the block members 28 are advanced forwardly by the actuation of pawl leaf 38.

EMBODIMENT OF FIG. 2

Figure 2:
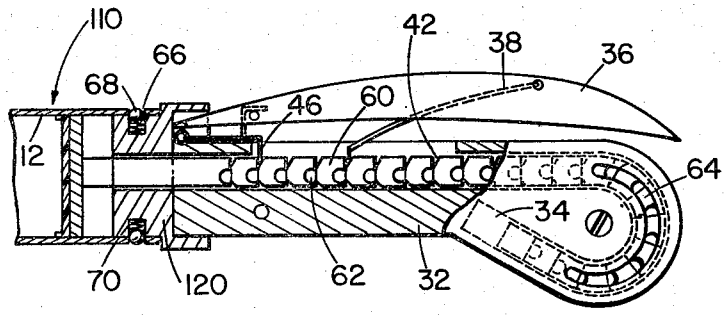
FIG. 2 represents, in a much reduced scale, the side view of FIG. 1 with the drive means being a molded link member and with the cartridge attached as ball detent.

In FIG. 2 the expelling apparatus shown is much like that of FIG. 1 above described but the blocks 28 and flexible strip 30 have been supplanted by a molded chain which includes molded blocks 60. These blocks may be of metal, such as sluminum or of plastic. It is contemplated that these blocks have their tongue portions 62 made or formed with a recess. A curved recess opening 64 is provided in one of the halves to enable a nail or the like to be inserted and at these recesses to engage the blocks 60 and urge the connected blocks to their rear condition as in FIG. 2. The container 110 is shown with opposed apertures 66 into which the balls 68 enter and retain the cartridge container 110 in mounted condition. Springs 70 urge the balls 68 into the formed recesses in the container. End member 120 carries these ball detent apparatus and any suitable member of detents may be provided

USE AND OPERATION

The apparatus of FIG. 2 is much like that of FIG. 1 and anticipates that the connected and molded blocks 60 are connected to shank portion 24 and in a connected array are movable in and are retained in the curved track 34. The lever handle 36, pawl leaf 38 and stop finger 46 are like or identical to that shown and described in connection with FIG. 1. The ramp or bevel notch 42 of block member 28 is provided on the molded blocks 60. The operation and disengagement in as above described.

EMBODIMENT OF FIG. 3

Figure 3:
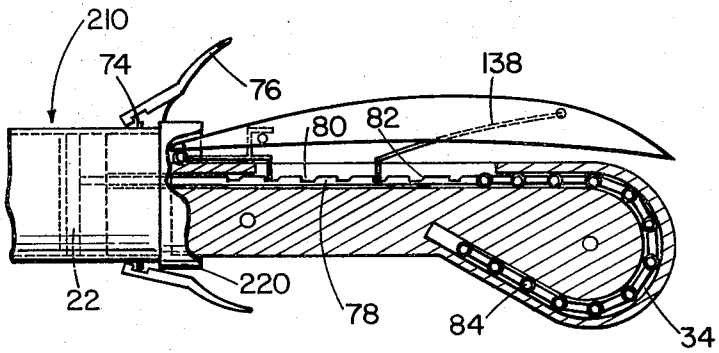
FIG. 3 represents, in the scale of FIG. 2, the side view, partly diagrammatic and showing yet another attachment concept using a latching device and advancing expelling apparatus.

Referring next to the diagrammatic view of FIG. 3, there is shown yet another attaching means and another expelling apparatus. As shown, the cylindrical container 210 has two or more protruding lugs or tabs 74 which are each engaged by like toggle clamps 76. These clamp members are commercially available and are depicted to show a means for securing the container to an end member 220. The drive of the piston disc 22 is shown as by a metal tape member 78. This tape has a series of notches 80 into which the bent end 82 of pawl leaf 138 is adapted to enter and urge the metal tape forwardly. Attached to the outer edge of the tape 78 may be hollow rivets 84 which may be engaged by a nail in an access opening as in FIG. 2 for the purpose of retracting this tape.

USE AND OPERATION

The apparatus of FIG. 3 shows the attachment of a container 210 by lugs or tabs 74 and toggle clamps 76. The drive is contemplated to be a metal tape such as the pull tape in a coiled measuring tape. These tapes are conventionally curved so that in a position outside their container they retain a stiff and straight attitude. This tape member 78 has a series of notches 80 that are sequentially engaged by the bent end 82 of the pawl leaf 138.

The lever handle 36 and stop finger 46 are like those described above. A nail or like implement may be used to return the tape to the curved track 34.

EMBODIMENT OF FIG. 4

Figure 4:
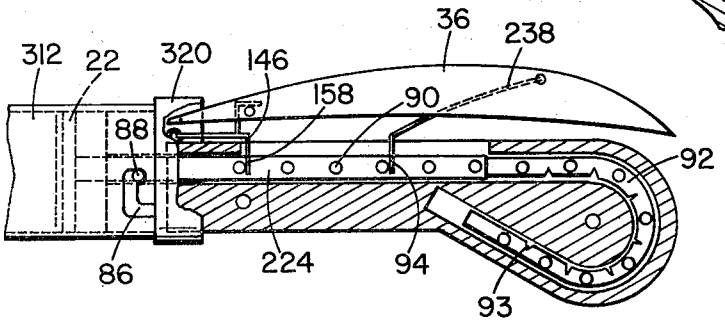
FIG. 4 represents, in the scale of FIG. 2, the side view, partly diagrammatic and showing yet another attachment apparatus employing a bayonet lock and a roller chain advancing and expelling apparatus.

The embodiment of FIG. 4 depicts the attachment of the tubular container by yet another ready attaching means. As depicted, a tubular body 312 is formed with a bayonet lock and cutout 86 which engages a round lug or projection 88 on end member 320. The piston disc 22 is shown attached to a shank portion 224 on which outwardly extending pin portions 90 are secured. To this shank portion, which is as long as the straight guide in the handle, is secured an alternate construction of the metal tape portion of FIG. 3. This rear tape portion has the downwardly extending side portions 92 formed with cutouts 93 and to these side portions are also secured pin portions 90. The pawl leaf 238 is made so that the downwardly extending ends 94 engage the pins 90 when the lever handle 36 is actuated. A modified stop finger 146 is shown with the downwardly extending engaging portion now modified to provide like stop portions 158 to engage pins 90 on each side of the advancing apparatus.

USE AND OPERATION

It is to be noted that the cartridge 312 is shown as secured by a turned container after entering on the pins 90 of the bayonet lock and cutout 86. The modifications of the metal tape of FIG. 3 anticipates that the shank portion 224 resides in the straight portion of the track 34. The flexible portion that is carried by and is movable in the curved portion of the track has cutouts in the sides of this metal tape.

The lever handle 36, as it is actuated, moves the depending ends of pawl leaf 238 into engagement of opposed pins 90. The engaging stop portion 158 of the modified stop finger 146 also engages the opposed pins 90 to prevent unwanted rearward movement.

EMBODIMENT OF FIG. 5

Figure 5:
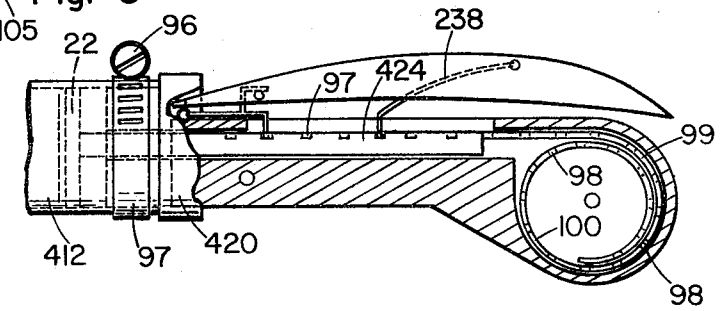
FIG. 5 represents, in the scale of FIG. 2, the side view, partly diagrammatic and showing yet another attachment concept and advancing and expelling apparatus.

Referring next to FIG. 5, it is contemplated that the tubular body 412 may be secured by an outside clamp 96. This clamp, as it is tightened, urges the body 412 into a shallow groove 97 formed in end member 420. In this embodiment it is contemplated that a U-shaped shank portion 424 has notches 98 formed therein. At the rear of this shank portion, which is as long as the straight portion of the track 34, is attached a metal strip 99 that carries metal blocks 100 to provide a flexible portion. These portions provide notch portions 98 into which the pawl leaf 38 enters and drives.

USE AND OPERATION

The embodiment of FIG. 5 contemplates attaching and retaining the cartridge container and in particular the tubular body 412 to the end member 420 by a clamp 96 usually tightened by a screw driver not shown. The piston disc 22 is moved by the U-shaped shank 424 and the pawl leaf 238. The metal strip 99 is attached to the shank 424 and the attached metal blocks 100 are engaged by the pawl leaf 238 to move the expelling apparatus forwardly. The strip 99 is sufficiently flexible to be disposed in the curved track 34. The apparatus shown in FIG. 5 is otherwise actuated as heretofore.

EMBODIMENT OF FIG. 6

Figure 6:
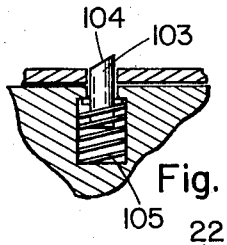
FIG. 6 represents a very fragmentary side view, partly diagrammatic and showing an alternate detent apparatus in which tapered pins are used rather than ball ends.

Referring next and finally to FIG. 6, there is fragmentarily shown an alternate for the ball detent mounting of FIG. 2. Rather than balls 68 there is provided pin ends with a forward to rear slope. As shown, pin portions 103 have a forward sloped outer end 104 to provide a cam or ramp means. This slope direction is established and maintained by a key or shaped opening. A spring 105 urges pin portions 103 outwardly to its predetermined and restrained limit. This alternate to the ball detent of FIG. 2 is shown and provided when the tubular body is rather thin or is less rigid than desired for retention by a ball detent.

The expelling apparatus contemplates the use of a curved track 34 and a handle within which this apparatus may be stored. The flexible drive means shown has not included a roller chain with attachments and link chain with special configurations. Such apparatus for maintaining a linear configuration may be used when and as the flexible drive has been advanced through the passageway or aperture in said end member. The lever handle 36 is pivoted for use in the advancing actuation and also is adapted to be swung with the pawl leaf into a disengaging condition. The handle or housing is formed with an access opening 107 into the curved track 34. This opening may be a slot or may be locally formed for entrance and driving contact of the pawl leaf into the trackway.

If a slot for both pawl and stop finger is not provided there is also provided in the housing an opening through which the stop finger also enters the trackway to engage the drive train to engage the beveled notch or the like and prevent counterflow actuation of the drive train during retractive motion of the pawl leaf. In the disengaged condition the piston disc is easily moved to return the drive train to its stored condition in the handle. Disengaged from the cartridge the handle may be stored until mounted to another cartridge. This apparatus is anticipated for use with any and all types of cartridges.

The expelling apparatus anticipates a compact unit that does not require and use a U-shaped retainer that engages the cartridge at both its front and rear ends. The curved track 34 containing the drive train in the handle enables a compact expelling apparatus to be employed with the lever handle providing a ratcheting action for a forward movement and the return utilizes a disengagement of the lever handle or the return may be by a nail or like means. The securing of the cartridge to the handle is to be simple and positive and at the rear of the cartridge. The expelling apparatus is inexpensive and reusable. The several examples are indicators of the concept and novelty of the invention.

Terms such as "left", "right", "up", "down", "front", "back" "in", "out", and the like are applicable to the embodiments shown and described in conjunction with the drawings. These terms are merely for the purposes of description and do not necessarily apply to the position in which the expelling and attaching means may be constructed or used.

While particular embodiments of the handle and cartridge attachment have been shown and described it is to be understood the invention is not limited thereto since modifications may be made within the scope of the accompanying claims and protection is sought to the broadest extent the prior art allows.

What is claimed is:

1. A retainer and propulsion apparatus carried in a selfcontained handle, said propulsion apparatus for use with a disposable tubular cartridge having a dispensing end and a larger end into which a propulsion disc is entered to drive a cup-shaped closure toward the dispensing end, said apparatus including:

(a) means for securely retaining a disposable tubular cartridge by its larger end to said propulsion apparatus, said apparatus having an end member providing the support for said securing means, and an aperture formed through said end member;

(b) a rigid shank portion movable in and through said aperture in said end member;

(c) a piston disc attached to and carried by said rigid shank and disposed to engage and move the cup-shaped closure in said cartridge;

(d) a flexible drive train attached to the rigid shank and having regularly spaced and shaped ratcheting means by which a precise movement of the drive train can be achieved;

(e) a housing which includes a cover portion and a mating portion secured together in a closed condition;

(f) a curved track formed and provided in the housing, said track adapted to slidably carry the shank and secured flexible drive train, the curved track providing a trackway guide and support for the drive train when the housing is closed;

(g) a lever handle pivotally carried and attached to the housing and disposed above said housing;

(h) a pawl leaf having one end pivotally secured to said lever handle and moved thereby, said pawl leaf biased away from said handle, the other end of said pawl leaf entering the housing through an opening to and into the curved track and adapted to engage and move the drive train at the ratcheting means, a movement of the lever handle and the pawl leaf toward the housing causing the engaged end of the leaf to move the drive train forwardly;

(i) a stop finger also pivotally mounted on the lever handle, said stop finger having an engaging portion disposed to enter the trackway and engage the ratcheting means and prevent unwanted movement of the drive train counterflow to the action of the pawl leaf, and (j) biasing and limiting means associated with the stop finger and the lever handle to provide and limit the outward movement of the lever handle with respect to the position of the stop finger.

2. A retainer and propulsion apparatus as in claim 1 in which the means for retaining the tubular cartridge to the end member is a screw thread compatibly formed in the tubular cartridge and said end member.

3. A retainer and propulsion apparatus as in claim 1 in which the means for retaining the tubular cartridge to the end member are plural ball detents carried in the end member and mating apertures formed in the tubular cartridge.

4. A retainer and propulsion apparatus as in claim 1 in which the means for retaining the tubular cartridge to the end member are plural detents, each detent being a pin biased outwardly and having a beveled slope and retained orientating means, the detents carried in the end member and with mating apertures formed in the tubular cartridge.

5. A retainer and propulsion apparatus as in claim 1 in which the means for retaining the tubular cartridge to the end member are plural toggle clamps carried by the end member and with lugs or pin means carried by the tubular cartridge adapted for engagement and retention of the cartridge on the end member.

6. A retainer and propulsion apparatus as in claim 1 in which the means for retaining the tubular cartridge to the end member are plural bayonet-type cutouts provided in the tubular cartridge and outwardly extending pin means are provided on and by the end member.

7. A retainer and propulsion apparatus as in claim 1 in which the means for retaining the tubular cartridge to the end member is a clamp that is tightened by external means, said end member having a shallow groove into which the tubular member is forced by the tightening of the clamp.

8. A retainer and propulsion apparatus as in claim 1 in which the drive train includes a series of like formed blocks, each block having a beveled notch diminishing from the front toward the rear, said blocks being secured to a flexible strip which is also secured to the rigid shank portion.

9. A retainer and propulsion apparatus as in claim 8 in which the blocks are of metal and the flexible strip is of cloth.

10. A retainer and propulsion apparatus as in claim 1 in which the drive train includes a steel tape which in its lineal attitude is straight and the tape is curved transversely to achieve and maintain said lineally straight condition, this tape also having notches of determined size and spacing, said notches adapted to be engaged by a pawl leaf and urged forwardly, the stop finger also shaped to enter said notches to prevent unwanted counterflow motion.

11. A retainer and propulsion apparatus as in claim 10 in which there is also provided on the drive train apertured rivets that provide retracting means for manual manipulation by a nail and the like, the retracting means movable in a curved access slot formed in the housing cover, the curved access slot being aligned with the curved track.

12. A retainer and propulsion apparatus as in claim 1 which includes forming a straight shank portion with a plurality of equally spaced and sized pin attachments and to said shank there is secured a steel tape formed into a U-shape with side portions having secured pin attachments, the sides having V-shaped cutouts enabling the tape to be bent into a curved attitude, said pawl leaf formed to engage the pin attachments and the stop finger also being extended and formed so as to engage the pin attachments.

13. A retainer and propulsion apparatus as in claim 1 in which the shank portion is rigid and is attached to a flexible metal strip which carries on its upper surface block members of plastic.

14. A retainer and propulsion apparatus as in claim 1 in which the shank portion is attached to a molded link series of members, each block in the flexible portion having a recess into which a tongue portion is pivotally retained, each block having a beveled notch providing an engaging abutment for receiving the distal end of the pawl leaf.

15. A retainer and propulsion apparatus as in claim 14 in which the tongue portion of the molded block is made less than the width of the block so as to provide engaging means for a nail and the like.

16. A retainer and propulsion apparatus as in claim 1 in which the lever handle and the stop finger are disposed to be swung from engagement of the drive train so that manual manipulation on the piston disc enables the drive train to be pushed into the trackway for another expelling action, after which the lever and associated pawl leaf and stop finger once again are brought to an expelling condition.

17. A retainer and propulsion apparatus as in claim 1 in which the pawl leaf is urged into engaging condition by a compression spring and the biasing means between the lever handle and the stop finger is also a compression spring.

* * * * *